US010865037B2

(12) United States Patent
Häfker et al.

(10) Patent No.: US 10,865,037 B2
(45) Date of Patent: Dec. 15, 2020

(54) METHOD FOR PRODUCING A CIGARETTE PACK

(71) Applicant: Focke & Co. (GmbH & Co. KG), Verden (DE)

(72) Inventors: Thomas Häfker, Langwedel (DE); Christoph Schneider, Verden (DE); Henry Buse, Visselhövede (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 0 days.

(21) Appl. No.: 16/326,312

(22) PCT Filed: Sep. 13, 2017

(86) PCT No.: PCT/EP2017/001085
§ 371 (c)(1),
(2) Date: Feb. 18, 2019

(87) PCT Pub. No.: WO2018/059729
PCT Pub. Date: Apr. 5, 2018

(65) Prior Publication Data

US 2019/0185252 A1 Jun. 20, 2019

(30) Foreign Application Priority Data

Sep. 30, 2016 (DE) ..... 10 2016 118 581

(51) Int. Cl.
*B65D 85/10* (2006.01)
*B65B 19/20* (2006.01)
(Continued)

(52) U.S. Cl.
CPC ..... *B65D 85/1045* (2013.01); *B65B 19/20* (2013.01); *B65B 19/223* (2013.01);
(Continued)

(58) Field of Classification Search
CPC ..... B65B 19/02; B65B 19/20; B65B 19/22; B65B 19/223; B65B 19/225;
(Continued)

(56) References Cited

U.S. PATENT DOCUMENTS 2,404,312 A 7/1946 Reynolds
3,531,914 A * 10/1970 Franklin ..... B65B 43/10 53/230
(Continued)

FOREIGN PATENT DOCUMENTS

CN 1169836 A 1/1998
CN 102112378 A 6/2011
(Continued)

OTHER PUBLICATIONS

EP machine translation of DE2609821, retrieved from espacenet.com, Aug. 4, 2020, 8 pages. (Year: 2020).*
(Continued)

*Primary Examiner* — Stephen F. Gerrity
(74) *Attorney, Agent, or Firm* — Laurence P. Colton; Smith Tempel Blaha LLC

(57) ABSTRACT

A cigarette pack, having an inner pack for pack contents, in particular for a group of cigarettes, and having an outer pack, preferably in the form of a hinge/lid pack, wherein the inner pack which preferably directly encases the pack contents has lateral walls made of cardboard, which are formed by overlapping lateral tabs of a blank for the inner pack. The invention is characterized in that end corner tabs, which are arranged on both sides of a lid wall of the inner pack, have a respective substantially V-shaped design, and in that each of the end corner tabs is arranged between inner lateral tabs and outer lateral tabs of the lateral walls of the inner pack.

5 Claims, 8 Drawing Sheets

(51) Int. Cl.
*B65B 19/22* (2006.01)
*B65D 75/58* (2006.01)

(52) U.S. Cl.
CPC ..... *B65B 19/228* (2013.01); *B65D 75/5838* (2013.01); *B65D 85/1018* (2013.01); *B65D 85/10568* (2020.05)

(58) Field of Classification Search
CPC . B65B 19/226; B65B 19/228; B65B 2230/04; B65D 85/1045; B65D 85/10568
USPC ..... 53/456, 462, 464, 466, 207, 220–225, 53/228, 230, 232, 234
See application file for complete search history.

(56) References Cited

U.S. PATENT DOCUMENTS 4,048,052 A 9/1977 Tolaas
4,653,252 A * 3/1987 van de Haar et al. ..... B65D 77/06 53/449
4,843,798 A * 7/1989 Focke et al. ..... B65B 19/20 53/453
5,113,638 A * 5/1992 Focke et al. ..... B65B 19/226 493/176
5,151,073 A * 9/1992 Focke ..... B65B 19/20 493/178
6,478,149 B1 * 11/2002 Parker ..... B65D 85/1036 206/273
7,134,257 B2 * 11/2006 Focke et al. ..... B65B 19/20 53/234
9,714,134 B2 * 7/2017 Tacchi et al. ..... B65D 85/1045
10,124,953 B2 * 11/2018 Bellannah et al. ..... B65D 85/1045
2009/0308766 A1 * 12/2009 Polloni et al. ..... B65D 85/1036 206/264
2011/0114518 A1 * 5/2011 Hein ..... B65B 19/223 206/268
2012/0291401 A1 11/2012 Mitten
2014/0059977 A1 * 3/2014 Boegli ..... B65B 19/228 53/411
2016/0130074 A1 5/2016 Kastha

FOREIGN PATENT DOCUMENTS

CN 202319082 U 7/2012
DE 2609821 A1 9/1977
DE 19506844 A1 8/1996
DE 19632764 A1 2/1998
DE 102004009399 A1 * 9/2005 ..... B65C 9/14
DE 102004009399 A1 9/2005
DE 102008035467 A1 2/2010
EP 2310300 A1 4/2011
EP 3007986 B1 * 8/2017 ..... B65D 85/1054
WO 2014199246 A1 12/2014

OTHER PUBLICATIONS

China National Intellectual Property Administration, Notification of First Office Action (in a related application), dated Jun. 2, 2020.
Deutsches Patent—Und Markenamt (German Patent and Trademark Office), Recherchenbericht (search in a related application), May 30, 2017.
WIPO, International Search Report (in a related application), dated Dec. 4, 2017.

* cited by examiner 10
11
12
13
14
15
16
17
18
19
20
21
22
23
24
25
26
27
28
29
31
32
34
35
36
37
38
40
41
42
46
47
48
49
50
51
53
55
56
86
91
IV
V 74
12
73
74
81
75
12
93
92
82
42
79
78
80
76
42
85
41
42
83
77
38
40
91

METHOD FOR PRODUCING A CIGARETTE PACK

CROSS REFERENCE TO RELATED APPLICATIONS

This application is the U.S. National Phase of and claims the benefit of and priority on International Application No. PCT/EP2017/001085 having a filing date of 13 Sep. 2017, which claims priority on and the benefit of German Patent Application No. 10 2016 118 581.7 having a filing date of 30 Sep. 2016.

BACKGROUND OF THE INVENTION

Technical Field

The invention relates to a cigarette pack, having an inner pack for pack contents, in particular for a group of cigarettes, and having an outer pack, preferably in the form of a hinge/lid pack, wherein the inner pack made of (thin) cardboard which directly encases the pack contents preferably has lateral walls, which are formed by overlapping lateral tabs of a blank for the inner pack. The invention further relates to a method or a device for producing a suchlike pack.

Prior Art

Numerous requirements are imposed on packs for cigarettes, whether from a design-related, constructive or economic point of view. A suchlike requirement relates to the fact that the pack contents must be protected from harmful environmental influences and the aroma in the pack must be preserved. So-called sealed packs, which protect the pack contents very effectively in this respect, have been developed against this background. The pack contents in this case are often wrapped in an inner wrapping made of foil, of which the folding tabs are closed by thermal sealing. An access opening is closed by means of a repeatedly operable closure label, which is connected to the pack by adhesive bonding. The production process for suchlike packs is relatively complex, however. In addition, statutory regulations exist in a number of countries, the aim of which is to prevent the pack contents from coming into contact with material of the foil or adhesive, in view of a degree of concern that chemical substances could migrate into the cigarettes from the foil or the adhesive.

BRIEF SUMMARY OF THE INVENTION

On this basis, the underlying object of the invention is to develop an improved cigarette pack, in particular with regard to protection of the pack contents, compliance with legal provisions and economical production. A further object of the invention is also to propose an appropriate production process or a production device.

In order to accomplish this object, an inventive pack is a cigarette pack, having an inner pack for pack contents, in particular for a group of cigarettes, and having an outer pack, preferably in the form of a hinge/lid pack, wherein the inner pack which directly encases the pack contents is preferably formed from (thin) cardboard and has lateral walls, which are formed by overlapping inner and outer lateral tabs of a blank made of (thin) cardboard for the inner pack, characterized in that end corner tabs, which are arranged on both sides of a lid wall of the inner pack in the region of the lateral walls, have a respective substantially V-shaped design, and in that each of the end corner tabs is arranged between the inner lateral tabs and outer lateral tabs of the lateral walls of the inner pack. It is proposed, therefore, that end corner tabs, which are arranged on both sides of a lid wall of the inner pack, in each case have a substantially V-shaped design, and that the end corner tabs in each case are arranged between inner lateral tabs and outer lateral tabs of the lateral walls of the inner pack.

Although packs having an inner and outer pack made of cardboard are known in practice, suchlike packs often suffer from disadvantages, in particular with regard to their visual quality, which are manifested as projecting edges, gaps between folding tabs or the like. In addition, a number of "pull-ups" are necessary, as a rule, in order to configure the appropriate blanks in such a way that the pack can be produced smoothly on conventional packaging machines.

The inventive solution deviates from the known prior art and proposes special end corner tabs to either side of the end wall of the inner pack. In contrast to the prior art, the end corner tabs are not arranged on lateral tabs of a rear wall of the inner pack, but on the end wall itself. This results not only in a tight inner pack, but also in a simple production method, which is described further below.

According to a preferred further development of the invention, it is proposed that the outer lateral tabs of the lateral walls of the inner pack, which the end corner tabs cover, have an inclined lateral edge. In this way, in conjunction with the V-shaped design of the end corner tabs, the visual impression of an envelope fold is created in the region of the lateral walls of the inner pack, of which the consumer otherwise becomes aware primarily from the region of the packs made of foil or paper.

According to a preferred embodiment of the invention, it is possible to envisage that the outer pack has a box part for receiving the inner pack and a lid pivotally mounted on the box part, wherein the inner pack with the lid opened protrudes from the box part, so that the lateral walls of the inner pack are partially visible, in particular in such a way that the visual impression with the pack opened created by the design of the overlapping end corner tabs and the outer lateral tabs is visible to the consumer.

A further special feature may involve the outer and/or the inner lateral tabs being deformed by embossing, in such a way that the outer and inner lateral tabs are in contact with one another outside the region of the end corner tabs.

This solution has the particular advantage that any gaps on the rear side, which would otherwise be produced by the end corner tabs lying between the inner and outer lateral tabs, are covered.

It can preferably be proposed that the outer lateral tabs are deformed in the region of an inclined lateral edge by the application of an embossing, in such a way that the outer and inner lateral tabs in the region deformed by embossing are in contact with one another and are connected to one another by adhesive bonding.

As an alternative, it can be proposed that the outer and/or inner lateral tabs are deformed by embossing outside the region of the end corner tabs, in such a way that the outer and inner lateral tabs in the region deformed by embossing are in contact with one another and are connected to one another by adhesive bonding.

In other words, it can be proposed that the inner and/or outer lateral tabs are deformed by the application of an embossing, in such a way that a pocket for receiving the end corner tabs is formed between the inner and outer lateral tabs, and that the inner and outer lateral tabs outside the region of the pocket are in contact with one another and are connected to one another by adhesive bonding.

A further special feature may involve walls of the blank of the inner pack in the region of the front wall of same being connected to one another by adhesive bonding by means of a tab formed on the blank, in particular in the region of two part walls of the front wall of the inner pack or in the region of the transition between a bottom wall and a front wall of the inner pack.

A further advantageous special feature may involve the inner pack having an access opening formed by punching in the material of a blank for the inner pack, wherein the material removed by punching is removed completely from the pack as waste.

It can preferably be proposed, furthermore, that the access opening of the inner pack is covered by a repeatedly operable closure label, which is permanently connected to the inner side of the lid front wall, so that the closure label is also opened or closed by actuation of the lid.

It can be proposed, furthermore, that the closure label is provided in a first zone with a strongly adhesive adhesive, with which the closure label is permanently connected to an inner end wall of the inner pack.

An inventive method is a method for producing cigarette packs as disclosed herein, characterized in that a blank for the inner pack made of (thin) cardboard is stamped into a pocket of a folding turret during partial folding of the blank, and in that inner lateral tabs in the region of lateral walls of the inner pack and bottom corner tabs of the inner pack are then folded and a group of cigarettes is introduced into the partially folded blank, and in that a front wall of the inner pack is then folded onto the group of cigarettes, and in that end corner tabs of the inner pack, which are arranged on both sides of an end wall of the inner pack and are connected thereto, are then folded into the inner lateral tabs of the lateral walls, and in that outer lateral tabs are then folded onto the end corner tabs and the inner lateral tabs. It is proposed accordingly that a blank for the inner pack made of (thin) cardboard is stamped into a pocket of a folding turret during partial folding of the blank, and that inner lateral tabs in the region of lateral walls of the inner pack and bottom corner tabs of the inner pack are then folded and a group of cigarettes is introduced into the partially folded blank, and that a front wall of the inner pack is then folded onto the group of cigarettes, and that end corner tabs of the inner pack, which are arranged on both sides of an end wall of the inner pack and are connected thereto, are then folded onto the inner lateral tabs of the lateral walls, and that outer lateral tabs are then folded onto the end corner tabs and the inner lateral tabs.

It can preferably be proposed that the partially finished inner pack is ejected from the pocket of the folding turret in conjunction with the folding of the front wall of the inner pack, wherein the end corner tabs are folded by folding devices arranged fixed in an ejection station of the folding turret into the respective plane of the lateral wall of the inner pack.

Furthermore, a special feature may involve the inner pack being provided with the closure label in the region of a label folding station, wherein the pack facing transversely to the transport direction and having an exposed end wall is transported facing sideways along an upright conveyor section, and a closure label is positioned initially against the exposed end wall and is then folded by means of a folding device in the region of the rear wall and the front wall. Protection is also sought additionally for this solution, regardless of the specific application purpose or the invention mentioned by way of introduction.

The pack in this case preferably has an access opening in the region of the end wall and the adjoining front wall of the pack, wherein the closure label is positioned on the pack in such a way that the access opening is closed.

The preferred procedure is for the closure label to be positioned on the pack in the label folding station by means of the folding device, whereas the pack is conveyed continuously in the transport direction, wherein the preferably U-shaped folding device, on the one hand, is moved together with the pack in the transport direction, and, on the other hand, is moved transversely to the transport direction, in order to fold the closure label against the rear wall and the front wall.

As the next step, it is preferably proposed that the inner pack with the closure label positioned thereon is fed to a folding turret for the production of the outer pack, wherein a blank for the outer pack is stamped into a pocket of the folding turret and is partially folded, and wherein the inner pack with a closure label is introduced into the outer pack as pack contents, and the front wall, lateral walls and lid of the outer pack are then formed by folding appropriate walls or tabs of the blank for the outer pack.

A device for producing the pack or for the implementation of the production method has:

a) a folding turret having pockets for receiving a blank for the inner pack made of (thin) cardboard,
b) means for stamping the blank into the pocket, whereby inner lateral tabs are folded in the region of lateral walls of the inner pack and bottom corner tabs of the inner pack,
c) means for feeding a group of cigarettes into the partially folded blank,
d) at least one folding device for folding a front wall of the inner pack onto the group of cigarettes,
e) an end tab folder for folding end corner tabs of the inner pack, which are arranged on both sides of an end wall of the inner pack and are connected thereto on the folded inner lateral tabs of the lateral walls, and
f) means for folding outer lateral tabs onto the end corner tabs and the inner lateral tabs.

In the case of the device, too, it can be proposed that a label folding station is positioned downstream of the folding turret for producing the inner pack, for the purpose of applying the closure label to the inner pack, and that a further folding turret is positioned downstream of the label folding station for the purpose of packing the inner pack with a closure label into a blank for an outer pack. In this case, too, independent and autonomous protection is sought for the special features of the label folding station.

BRIEF DESCRIPTION OF THE DRAWINGS

The invention is described below on the basis of preferred illustrative embodiments represented in the drawing, in which.

DETAILED DESCRIPTION OF PREFERRED EMBODIMENTS

Figures 1, 2, 3:
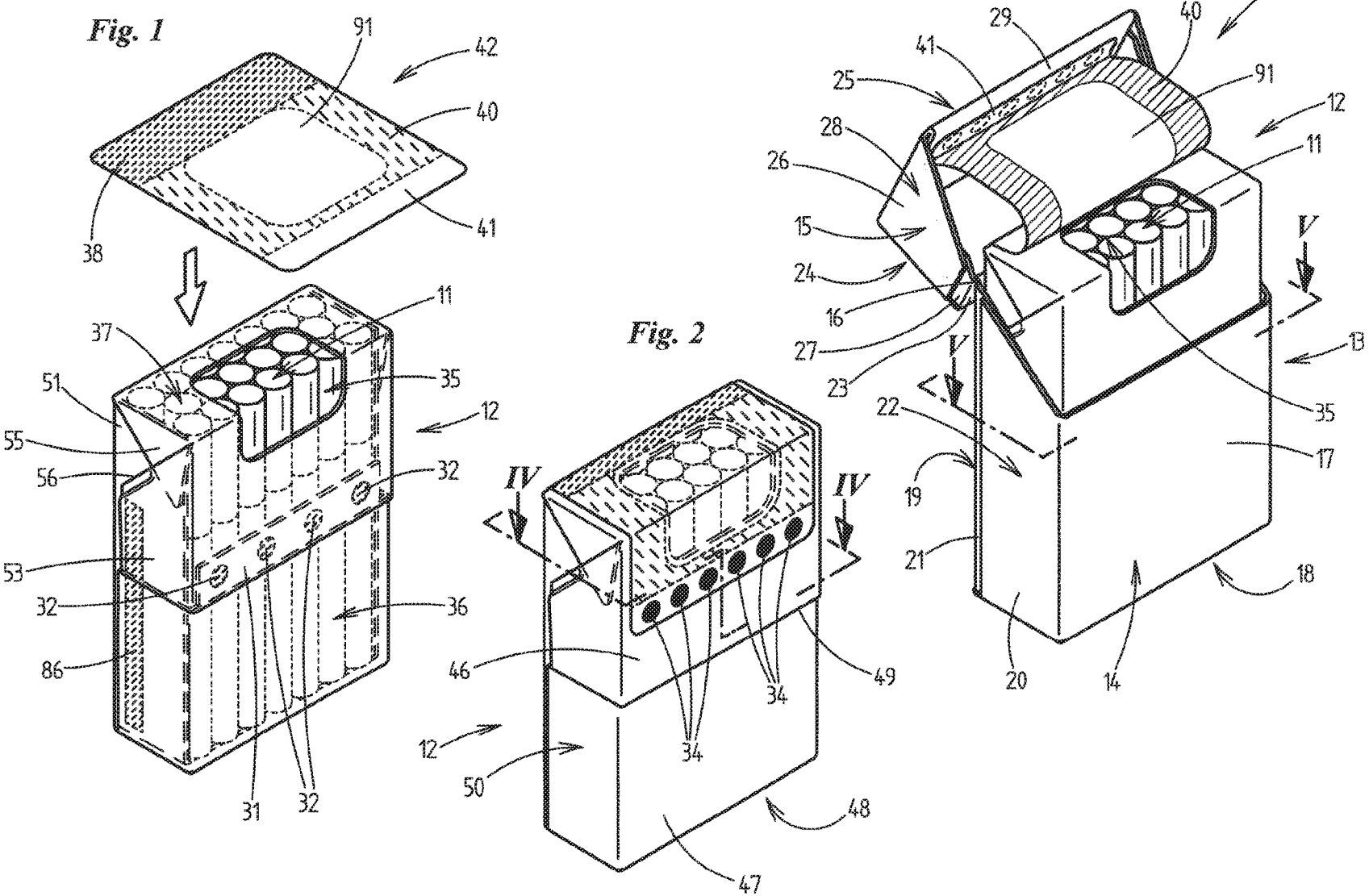
FIG. 1 depicts an inner pack and a closure label.
FIG. 2 depicts an inner pack having a closure label applied thereto.
FIG. 3 depicts a cigarette pack having an outer pack and an inner pack present therein according to FIGS. 1 and 2.

The pack 10 in question serves to receive cigarettes as pack contents. A group of cigarettes 11 formed from a plurality of cigarettes arranged in formation fills the interior of a partial pack, in particular an inner pack 12. This is designed as a tight pack.

The cigarettes are arranged without additional inner wrapping, that is to say directly in the inner pack 12. The cuboidal inner pack 12 itself constitutes the contents of an outer pack 13, in this case in the embodiment of a classical tab box or hinge/lid pack.

The outer pack 13 in all three depicted illustrative embodiments is designed identically in the form of a tab box or hinge/lid pack and consists in a manner known per se of a (lower) box part 14 and a lid 15. This is connected integrally to the box part 14 by means of a transverse line hinge 16.

The box part 14 consists of a box front wall 17, a box bottom wall 18 and a box rear wall 19. External box lateral tabs 20 are positioned on both sides of the box front wall 17, and internally located box lateral tabs 21 are positioned on the box rear wall 19. These together form box lateral walls 22, in particular as a consequence of covering and connection (glue 87) to one another.

The lid 15 consists of a lid rear wall 23, an upper lid end wall 24 and a lid front wall 25 adjoining the box rear wall 19. Lid lateral tabs 26, 27 are arranged laterally on a lid rear wall 23 and a lid front wall 25 in order to form lid lateral walls 28.

A lid inner tab 29, which is folded against the inner side of the lid front wall 25 and is connected to the latter by adhesive bonding, for example by means of glue points, adjoins a free edge of the lid front wall 25.

Corner tabs, in particular bottom corner tabs and lid corner tabs, are arranged on the (inner) box lateral tabs 21 and corresponding to the (inner) lid lateral tabs 26. These are capable of being folded against the inner side of the box bottom wall 18 and the lid end wall 24.

As in the case of suchlike packs, an appropriate blank 30 for the outer pack 13 can usually be made of (thin) cardboard or an equivalent packaging material with appropriate or greater dimensional stability.

Figure 6:
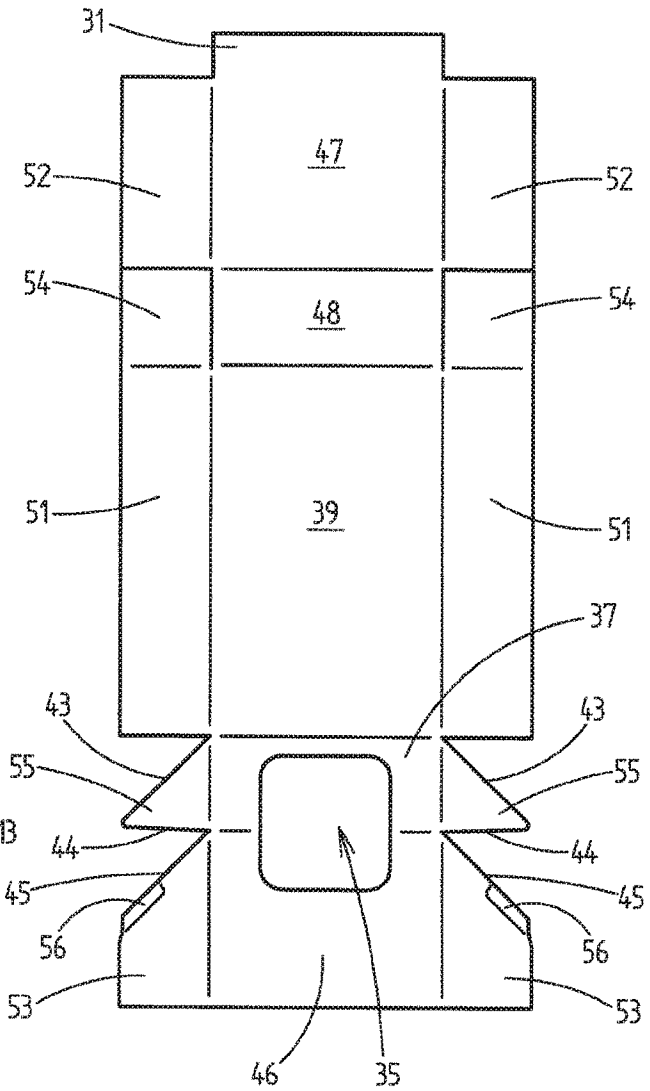
FIG. 6 depicts a blank for the inner pack.
Figure 4:
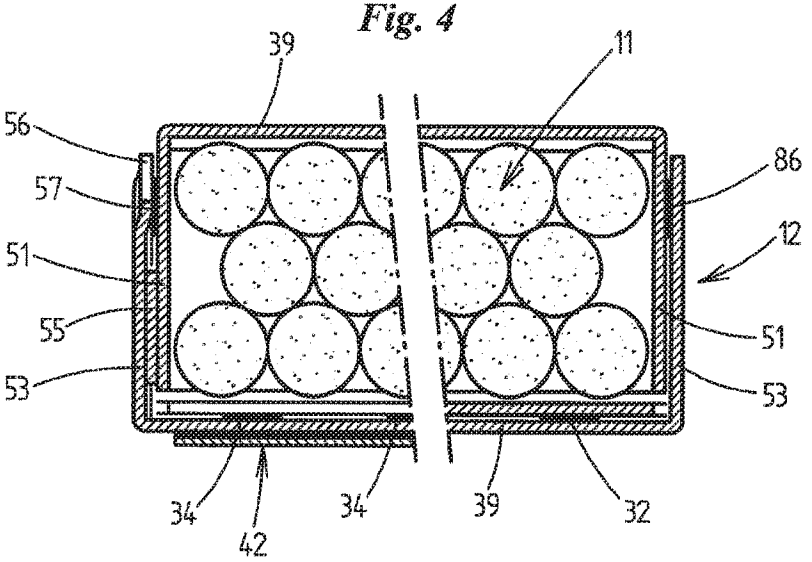
FIG. 4 depicts a horizontal section through the pack along the line of intersection IV-IV in FIG. 2.
Figure 5:
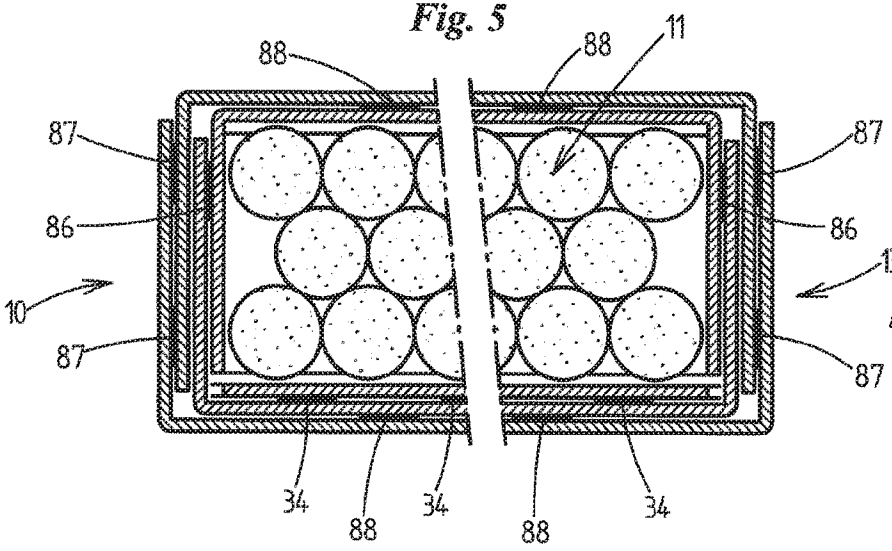
FIG. 5 depicts a horizontal section through the pack along the line of intersection V-V in FIG. 3.

The inner pack 12 and its blank 33 (FIG. 6) are designed in a particular manner. The blank 33 for this purpose is likewise made of (thin) cardboard with a coating on one or both sides. The coating is designed in such a way that the packaging material as a whole is moisture-proof or aroma-proof. In particular the coating consists of plastic and/or a varnish layer and/or a metallic or metallized layer. The cardboard is coated preferably on only one external side. This solution offers a number of advantages. The cardboard is thus able to serve as a storage means for moisture and, for example, either to protect the pack contents from drying out or alternatively to absorb high moisture from the environment, in order thereby to prevent the pack contents from becoming too damp. In addition, the exchange of moisture and/or flavoring agents between the pack and the environment is restricted by the coating. On the whole, a comparatively moisture-proof and aroma-proof pack 10 results in this way.

The inner pack 12 forms a closed, cuboidal container for the group of cigarettes 11. For the withdrawal of the pack contents, that is to say the cigarettes, an access opening 35 is formed, which extends in the region of an inner front wall 36 and at least in the region of an adjoining inner end wall 37 of the inner pack 12.

The access opening 35 is designed in the case in question by the positioning of a punching in the material of the blank 33 for the inner pack 12. The material removed by punching can be either removed completely as waste or folded against the blank 33. In the latter case, the punching cut is not performed continuously around the access opening 35, but only partially, so that a residual connection remains, about which the material removed by punching can be folded against the blank 33. The material is preferably removed by punching, in this case folded against the inner side of the blank 33, so that it is not visible to the consumer.

The access opening 35 is covered by a re-usable actuating device, in particular by a closure label 42 configured as a tape. This consists of a foil and is provided with adhesive on the side (underside) facing towards the inner pack 12.

In the case in question, the underside of the closure label 42 is divided into three zones. A strongly adhesive adhesive, which serves for the permanent connection of the closure label 42 to the inner pack 12 in the region of the inner end wall 36 and an inner rear wall 39 of the inner pack 12 is provided in a first zone 38. The first zone 38 begins at an upper edge of the closure label 42 and extends more or less as far as the upper edge of the access opening 35. A strongly adhesive adhesive, which allows repeated actuation of the closure label 42, is provided in a second zone 40, which adjoins the first zone 38 and extends around the access opening 35 in a U-shaped manner and ends shortly beneath a lower edge of the access opening 35. In a third zone 41, which adjoins the second zone 40 and extends continuously as far as the lower edge of the closure label 42, no adhesive is provided on the underside of the closure label 42. Accordingly, an adhesive-free zone 91, which extends somewhat beyond the edge of the access opening 35, is present in the region of the access opening 35 The aim is to prevent the penetration of adhesive or adhesive vapors into the inner pack 12 in this way, in order to protect the pack contents. Glue points 34 for the permanent adhesive bonding of the closure label 42 to the inner side of the lid front wall 25 are provided on an upper side of the closure label 42 facing towards the outer pack 13 in the region of the third zone 41, so that the closure label 42 is also opened or closed by the actuation of the lid 15.

The blank (FIG. 2) for the inner pack 12 is designed in a particular manner.

In the first illustrative embodiment according to FIGS. 1 to 6, the inner rear wall 39 extends uninterrupted over the full extent or height of the inner pack 12. The inner front wall 36 is divided more or less centrally. A first, upper part wall 46 is connected to the inner end wall 37. A second, lower part wall 47 adjoins an inner bottom wall 48. In the finished inner pack 12, the part walls 46, 47 combine together to form the inner front wall 36 in the region of a transverse parting line 49.

The blank 33 of the inner pack 12 has inner lateral tabs, which cover one another and are connected to one another by adhesive bonding in order to form inner lateral walls 50.

The inner rear wall 39 is provided for its full height with continuous integral rear lateral tabs 51. External lateral tabs of the inner front wall 36 are likewise divided in the region of the inner lateral walls 50 and, as a consequence, form part lateral tabs 52, 53, which in the case of the folded inner pack 12 form the external surface of the inner lateral walls 50 in continuation of the parting line 49. The continuous, internally located rear lateral tabs 51 assure the stability of the inner pack 12.

Corner tabs, in particular inner bottom corner tabs 54 for positioning on the inner side of the inner bottom wall 48, arranged on the rear lateral tabs 51.

End corner tabs 55 are designed in a particular manner, in particular with a triangular shape or a V-shaped design. The end corner tabs 55 are arranged to either side of the inner end wall 37 and are connected to the latter by means of a fold line. The end corner tabs 55 are separated by punching cuts in relation to the rear lateral tabs 51 and the part lateral tabs 53 to either side of the upper part wall 46 of the inner front wall 36.

In the depicted illustrative embodiment, the end corner tabs 55 extend in the transition to the inner end wall 37 initially for the same width as the inner end wall 37 and then converge in the form of a V. The depth of the end corner tabs 55 in this case corresponds to the depth of the rear lateral tabs 51 and the part lateral tabs 53. A lateral edge 43 of the end corner tabs 55 is clearly oriented at an angle towards the principal axes of the blank 33, at an angle of slightly less than 45° thereto, whereas the other lateral edge 44 of the end corner tabs 55 is oriented at only a small angle to the transverse axis of the blank.

The part lateral tabs 53 to either side of the upper part wall 46 of the inner front wall 36 also have a special design and are provided with an inclined lateral edge 45, which, like the lateral edge 43 of the part lateral tabs 53, runs oriented at an angle of approximately less than 45° in relation to the principal axes of the blank 33. At the same time, the lateral edges 45 and the lateral edge 44 respectively of the end corner tabs 55 are arranged in this case adjoining one another on the same side of the blank 33. Because of the inclined lateral edge 45, the part lateral tabs 53 as a whole have a substantially trapezoidal design.

In the folded inner pack 12, the end corner tabs 55 make contact between the outer rear lateral tabs 51 and the inner part lateral tabs 53. Because of the above described shape of the part lateral tabs 53 and the end corner tabs 55, the visual impression of an envelope fold occurs in the upper region of the inner lateral walls 48 in each case, as can otherwise frequently be found in inner packs made of a foil material.

In order to prevent a rear gap from occurring, because of the end corner tabs 55, between the rear lateral tabs 51 and the part lateral tabs 53, deformation of the material of the part lateral tabs 53 formed by embossing is proposed as a further special feature, which is configured outside the region of contact of the end corner tabs 55 with the part lateral tabs 53, in particular along the lateral edge 45. This is provided with an embossing region 56 in the section which protrudes beyond the end corner tabs 55. In the embossing region 56, the part lateral tab 53 is deformed in such a way that it bears against the rear lateral tab 51, and the formation of a gap between these two parts is thus prevented. The two parts are connected to one another by an appropriately positioned glue point 57. The embossing region 56 extends as far as the free end of the lateral edge 45. The inner rear lateral tabs 51 and the part lateral tabs 52, 53 are connected to one another by adhesive bonding, for example by glue points or a glue strip 86, outside the region of the envelope-like folding.

The inner bottom corner tabs 54 are generally of rectangular configuration, as in the prior art. This also applies to the rear lateral tabs 51 and the part lateral tabs 52. Consequently, the visual impression of an envelope fold is created in the region of the inner lateral walls 50 only in the upper part of the inner pack 12, which protrudes from the box part 14. The inner lateral walls 50 are of conventional design in the lower part of the inner pack 12.

A further special feature relates to a tab 31 for the connection of the two part walls 46, 47 of the inner front wall 36. The tab 31 is arranged in extension of the lower part wall 47 and is connected by adhesive bonding to the upper part wall 45, preferably by a row of glue points 32.

The inner pack 12 fills the outer pack 13 completely. In addition, the inner pack 12 can be secured in the outer pack 13 with glue 88. The access opening 35 is positioned so that the access opening 35 is freely accessible with the lid 15 of the outer pack 13 opened. The outer pack 13 is designed as a tab box without collars.

Figure 8:
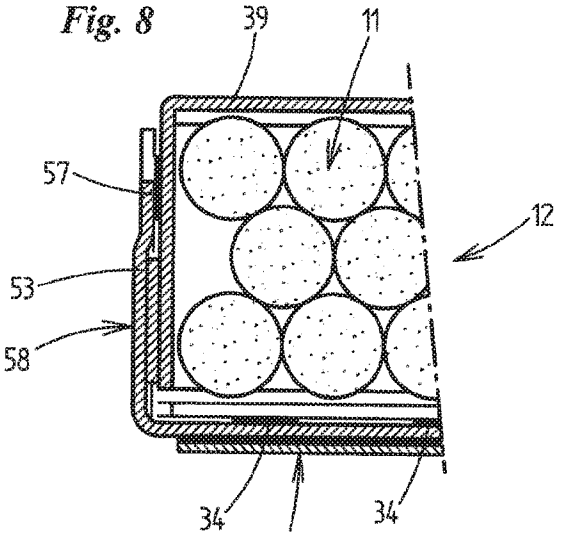
FIG. 8 depicts a horizontal section through the pack along the line of intersection VIII-VIII in FIG. 7.
Figure 9:
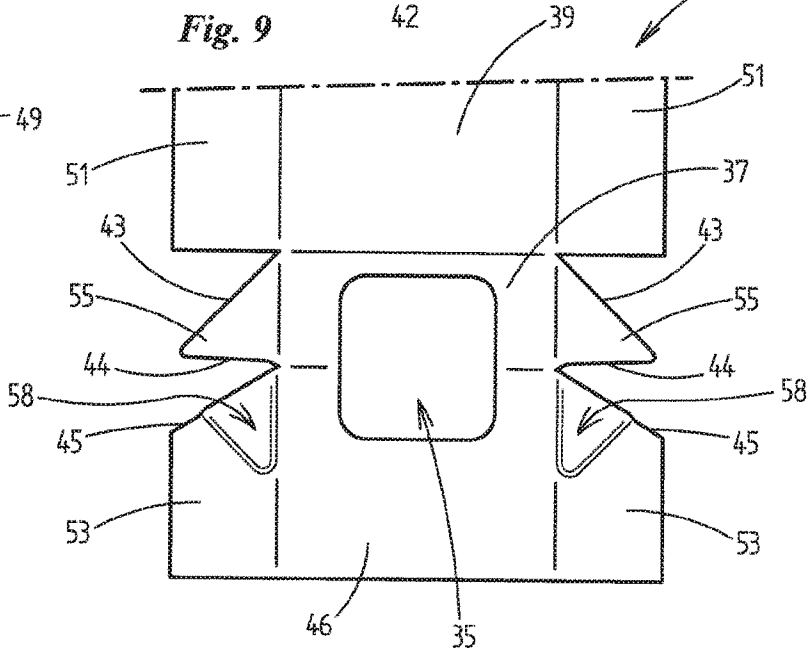
FIG. 9 depicts part of a blank for the inner pack of the second illustrative embodiment.
Figure 7:
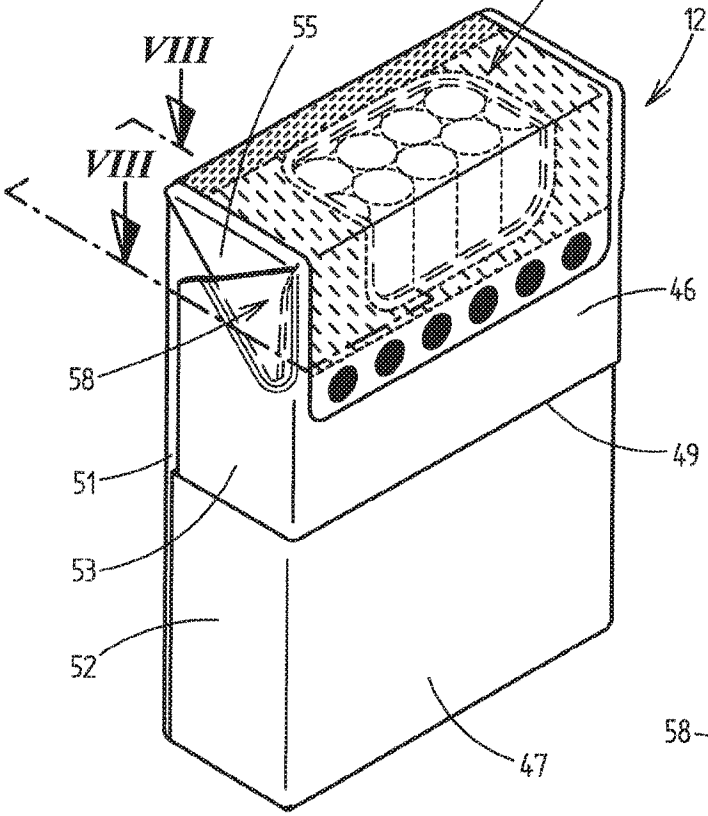
FIG. 7 depicts a second illustrative embodiment of an inner pack in a representation analogous to FIG. 2 of the first illustrative embodiment.

The second illustrative embodiment according to FIGS. 7 to 9 differs from the first illustrative embodiment described above by the construction of the part lateral tabs 53. An embossed zone 58, in which the end corner tabs 56 are accommodated, is present instead of an embossing region 56 along the lateral edge 45.

In the region of the embossed zone 58, the respective part lateral tabs 53 are deformed by embossing in such a way that a kind of "pocket" is formed, which corresponds to the respective end corner tabs 55 of the inner pack 12 with regard to its dimensions and position. The part lateral tabs 53 are consequently deformed outwards in the region of the zone 58.

Figure 12:
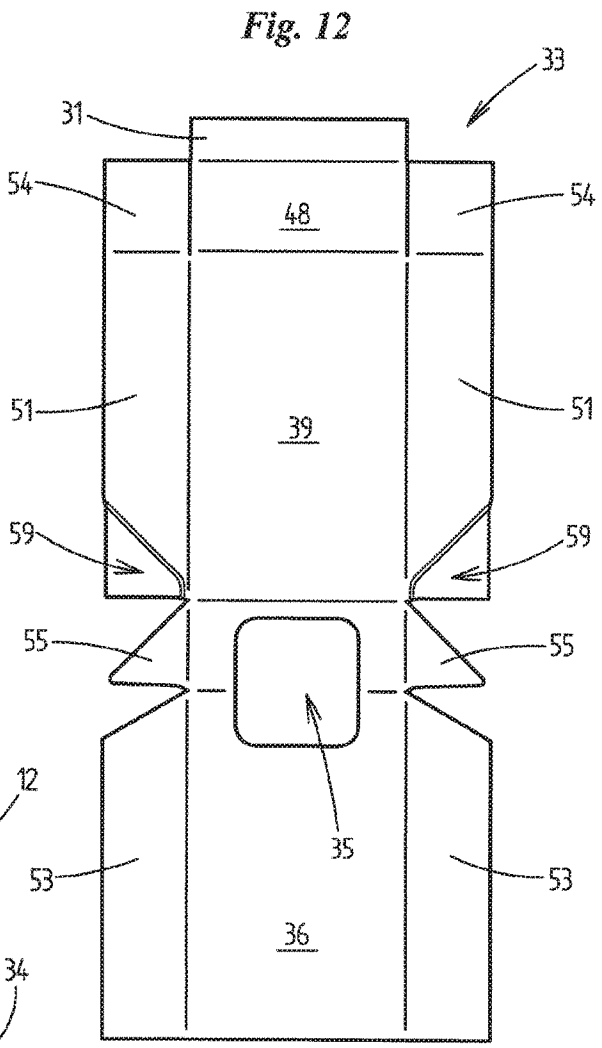
FIG. 12 depicts a blank for the inner pack of the third illustrative embodiment.
Figure 11:
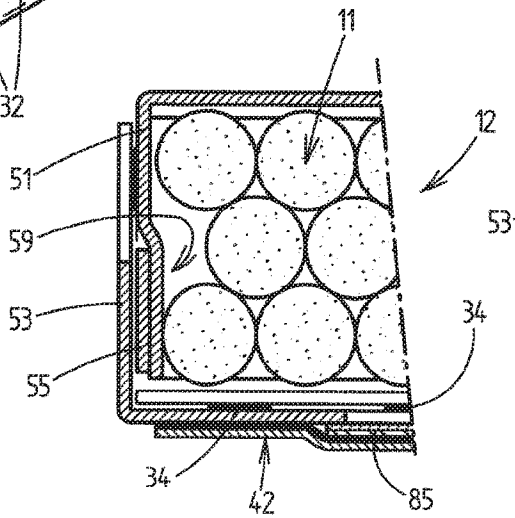
FIG. 11 depicts a horizontal section through the pack along the line of intersection XI-XI in FIG. 10.
Figure 10:
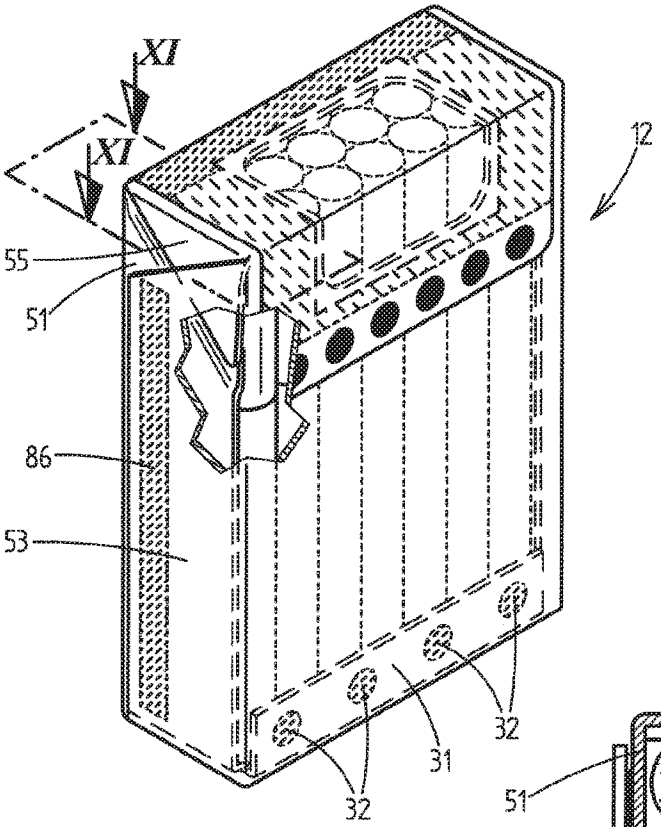
FIG. 10 depicts a third illustrative embodiment of an inner pack in a representation analogous to FIG. 2 of the first illustrative embodiment.

The third illustrative embodiment according to FIGS. 10 to 12 differs from the first illustrative embodiment described above likewise by the construction of the part lateral tabs 53. An embossed zone 59 finds an application here, as in the second illustrative embodiment, albeit being arranged in the region of the rear lateral tabs 51, corresponding to the respective position of the end corner tabs 55 on the inner pack 12. The rear lateral tabs 51 are consequently deformed inwards, in order to form a "pocket" for the end corner tabs 55.

The third illustrative embodiment further depicts a variant of the closure label 42. This is continuous on the underside, that is to say is also provided with adhesive in the region of the access opening 35. In order to prevent the pack contents from being compromised by the adhesive, a cover 85, for example made of silver foil, is positioned in the region of the access opening 35. The cover 85 extends circumferentially somewhat beyond the access opening 35, so that an overlap region is created (FIG. 11).

The blank 33 is also slightly modified, in particular in the sense that the inner front wall 36 is designed integrally. The tab 31 is accordingly arranged at the end of the inner bottom wall 48 and is connected to the inner front wall 36. Because of the modified construction of the blank, the outer lateral tabs of the inner lateral walls 50 are also no longer formed from part lateral tabs 52, 53, but in addition only from the (extended) lateral tabs 53.

It will be appreciated that both of the last-mentioned modifications of the blank 33 are also capable in principle of finding an application in the first two illustrative embodiments.

Figures 15, 17:
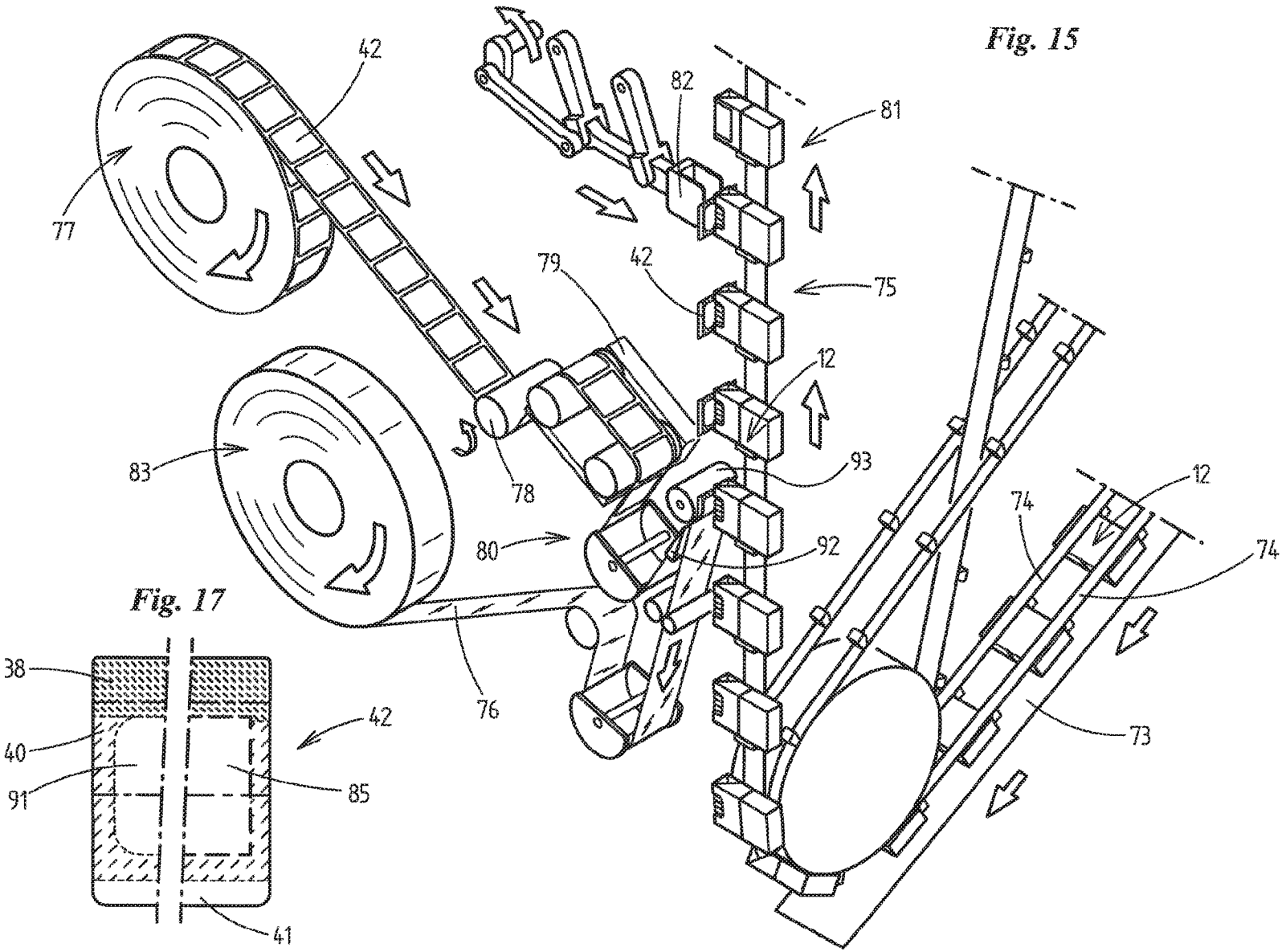
FIG. 15 depicts a schematic representation of an arrangement for applying the closure labels to the inner packs.
FIG. 17 depicts a closure label.
Figure 16:
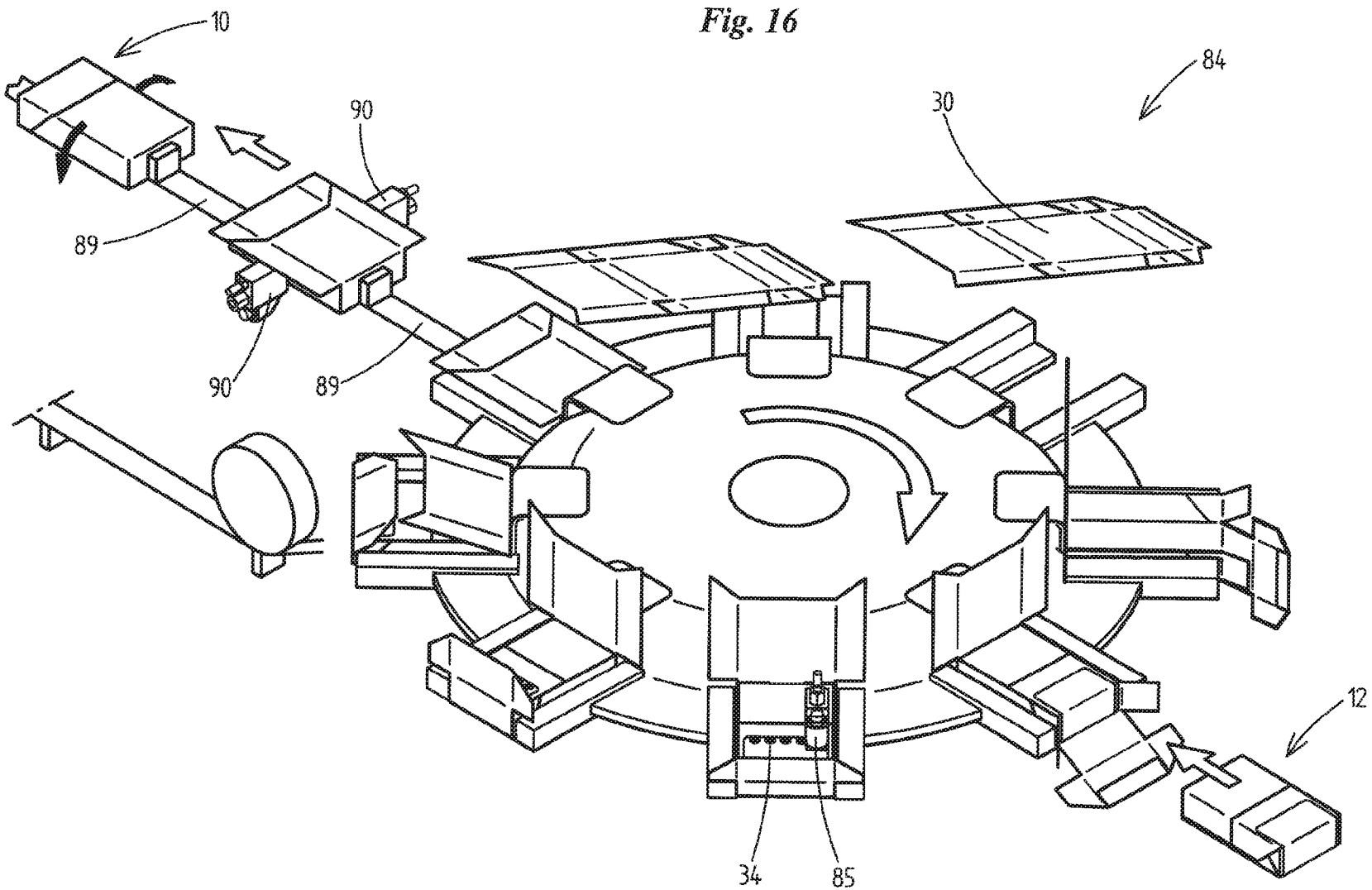
FIG. 16 depicts a schematic representation of a folding turret for producing the outer pack.

The production of the packs 10 described above is represented by way of example in FIGS. 13 to 16. Of these, FIGS. 13 and 14 initially depict the production of the inner pack 12. FIG. 15 depicts the positioning of the closure labels, and FIG. 16 depicts the production of the outer pack 13.

Figure 13:
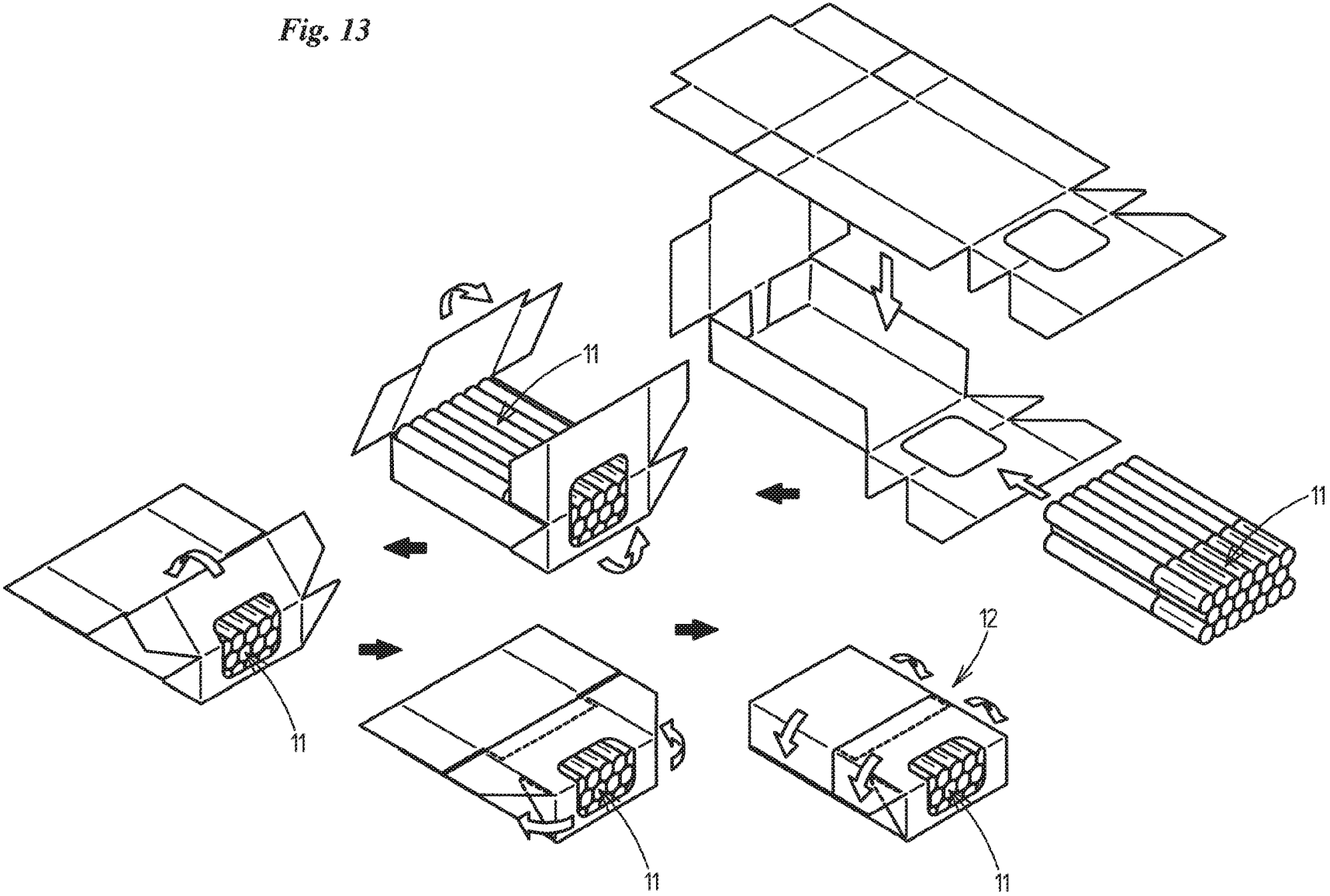
FIG. 13 depicts a schematic representation of the folding steps for producing the inner pack according to the first two illustrative embodiments.

The sequence of the important folding steps, which are necessary in order to fold an inner pack 12 from the blank 33, is represented initially in FIG. 13. The unfolded blanks 33 are accordingly brought into a first intermediate folded position, in particular by the erection of the rear lateral tabs 51, the inner end wall 36 and the lower part wall 47 of the inner front wall 36. The inner bottom corner tabs 54 are also folded, and the group of cigarettes 11 is supplied. In the following step, the part wall 47 is folded onto the group of cigarettes 11, and the inner end wall 37 and the upper part wall 46 of the inner front wall 36 are erected. The upper part wall 46 as well as the lower part wall 47 are then folded onto the group of cigarettes 11. The end corner tabs 55 are subsequently folded, and the part lateral tabs 52, 53 are then folded into the plane of the inner side walls 50.

Figure 14:
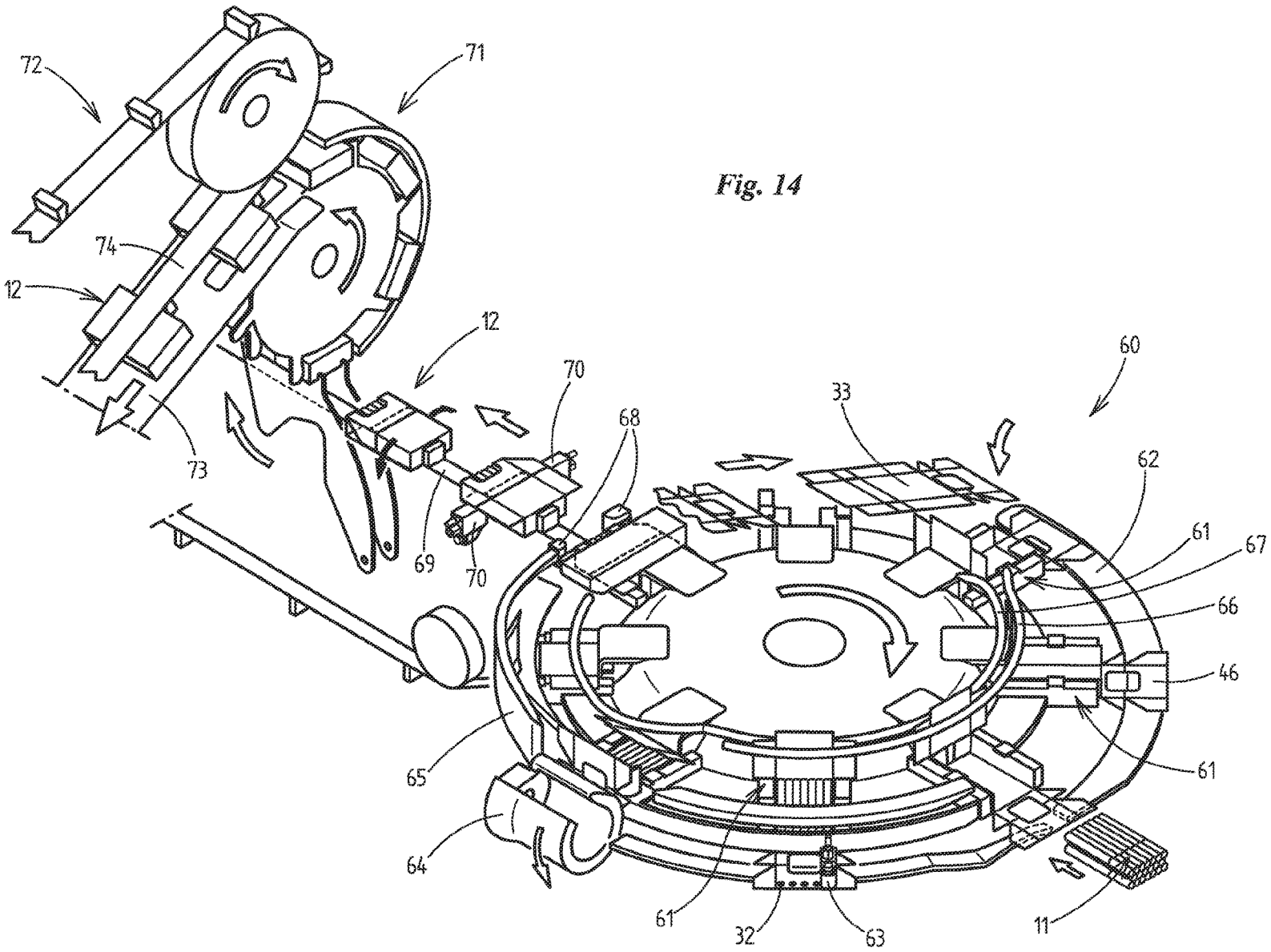
FIG. 14 depicts a schematic representation of an appropriate folding turret for the implementation of the folding steps according to FIG. 13.

FIG. 14 depicts an appropriate folding turret 60 for the implementation of the steps described above.

The folding turret 60 has pockets 61 evenly distributed over the circumference thereof. Stamping the blanks 33 is accompanied in every case by the formation of the intermediate folded position. A guide 62 extending along the circumference serves to support the upper part wall 46 of the inner front wall 36 during the feeding of the group of cigarettes 11 and during the application of glue points 32 positioned on the circumference of the folding turret 60 by means of a glue nozzle 63. Folding around the inner end wall 37 and the part wall 46 is effected by means of an active folding device 64 and a subsequent folding switch point 65. Guides 66, 67 are also used for guiding and folding back the lower part wall 47.

The folding method or the individual steps described thus far need to be modified slightly for an inner pack 12 according to the third illustrative embodiment, in which the inner front wall 36 is designed integrally. The folding procedure then corresponds substantially to the folding procedure for a conventional hinge/lid pack (tab box).

In an ejection station for the folding turret 60, fixed end tab folders 68, which take care of the folding back of the end corner tabs 55, are arranged in the conveying path of the inner pack 12.

In the course of the further transport of the partially finished inner packs 12 on a driving belt 69, the glue 86 (preferably hot-melt) is applied initially in the region of the inner lateral walls 50 by means of glue nozzles 70 arranged laterally next to the transport section, and the part lateral tabs 52, 53 are then folded down and the inner pack 12 closed.

The inner pack 12 is then pushed into a pocket of a rotating wheel 71 and is transferred to a push-off device 72*a* extending transversely in relation to the transport direction of the driving belt 69.

In the region of the push-off device 72, the inner packs 12 are conveyed along a downward-inclined sliding plate 73 by means of overlying driving belts 74. At the end of the sliding plate 73, the inner packs 12 are diverted into an upright conveyor section 75 and are transported continuously upwards at a preferably constant speed. At the same time, the inner packs 12 lie on an inner lateral wall 50, that is to say transversely to transport direction, so that the inner end wall 37 is exposed laterally, for the purpose of positioning of the closure labels 42.

The closure labels 42 are positioned on a continuous carrier strip 76, which is drawn from a corresponding label reel 77 by means of a drive roller 78, passes through a web edge control 79 and finally a compensating pendulum 80. The closure labels 42 are then peeled from the carrier strip in the region of a deflector 92 and are transferred to a suction roller 93, which delivers the closure labels 42 against the inner end walls 37 of the inner packs 12. The carrier strip 76 is wound onto a carrier strip reel 83.

The inner packs 12 next pass through a label folding station 81, in which the two legs of the closure labels 42 protruding laterally beyond the inner end walls 37 are positioned against the inner rear wall 39 and the inner front wall 36 of the inner packs 12. The label folding station 81 possesses a U-shaped folding device 82 for this purpose, which is moved appropriately against the inner pack 12. At the same time, the folding device 82 accompanies the inner packs 12 in the course of the application of the closure labels 42.

The inner packs 12 provided with the closure labels 42 are then fed to a further folding turret 84 and are packed there into the outer packs 13. The folding turret 84 is designed appropriately as a standard folding turret for tab boxes, but with the difference that the inner pack 12 replaces a cigarette block with collars. The only special feature is the provision of a glue nozzle 85 for applying the glue points 34 to the external surface of the closure labels 42 for connection to the inner side of the lid front wall 28 on a station of the folding turret 84. Subsequently to the folding turret 84, the finished folded packs 10 as far as the box lateral walls 22 are transferred to a driving belt 89. Glue 87 is applied in the customary manner by means of glue nozzles 90 in the region of the box lateral walls 22, and the box lateral tabs 20, 21 are connected to one another to produce box lateral walls 22.

Inner packs 12 and outer packs 13, of which the upright pack edges are designed identically so that the packs have a rectangular cross section, are depicted respectively in the depicted illustrative embodiments. Beveled or rounded pack edges are also conceivable, of course. Packs which have differently shaped pack edges, for example packs of which the upright pack edges in the region of the front side are shaped differently from the upright pack edges in the region of the rear side, are conceivable in addition. It is also conceivable for individual pack edges to be designed differently from other pack edges. It is further conceivable for the different pack edges to be combined with one another in any desired way.

LIST OF REFERENCE DESIGNATIONS

10 pack
11 group of cigarettes
12 inner pack

13 outer pack
14 box part
15 lid
16 line hinge
17 box front wall
18 box bottom wall
19 box rear wall
20 box lateral tab
21 box lateral tab
22 box lateral wall
23 lid rear wall
24 lid end wall
25 lid front wall
26 lid lateral tab
27 lid lateral tab
28 lid lateral wall
29 lid inner tab
30 blank (outer pack)
31 tab
32 glue point
33 blank (inner pack)
34 glue point
35 access opening
36 inner front wall
37 inner end wall
38 first zone
39 inner rear wall
40 second zone
41 third zone
42 closure label
43 lateral edge
44 lateral edge
45 lateral edge
46 upper part wall
47 lower part wall
48 inner bottom wall
49 parting line
50 inner lateral wall
51 rear lateral tab
52 part lateral tab
53 part lateral tab
54 inner bottom corner tabs
55 end corner tabs
56 embossing region
57 glue point
58 embossed zone
59 embossed zone
60 folding turret (inner pack)
61 pocket
62 guide
63 glue nozzle
64 folding device
65 folding switch point
66 guide
67 guide
68 end tab folder
69 driving belt
70 glue point
71 rotating wheel
72 push-off device
73 sliding plate
74 driving belt
75 conveyor section
76 carrier strip
77 label reel
78 drive roller
79 web edge control
80 compensating pendulum
81 label folding station
82 folding device
83 carrier strip reel
84 folding turret (outer pack)
85 cover
86 glue strip
87 glue
88 glue
89 driving belt
90 glue nozzle
91 adhesive-free zone
92 deflector
93 suction roller

What is claimed is:

1. A method for producing cigarette packs (10) comprising:

stamping a blank (33) for an inner pack (12) made of thin cardboard into a pocket (61) of a folding turret (60) during partial folding of the blank (33), the inner pack (12) having a front wall (36), an end wall (37), a rear wall (39), a bottom wall (48), inner lateral tabs (51) extending from the rear wall (39), bottom corner tabs (54) extending from the inner lateral tabs (51), end corner tabs (55) extending from the end wall (37), and outer lateral tabs (52, 53) extending from the front wall (36);

folding the inner lateral tabs (51) in a region of lateral walls (50) of the inner pack (12) and the bottom corner tabs (54) of the inner pack (12), the lateral walls (50) being formed by overlapping of the inner and outer lateral tabs (51, 52, 53);

introducing a group of cigarettes (11) into the partially folded blank (33);

folding the front wall (36) of the inner pack (12) onto the group of cigarettes (11);

folding the end corner tabs (55) of the inner pack (12), which are arranged on both sides of the end wall (37) of the inner pack (12) and are connected thereto, into the inner lateral tabs (51) of the lateral walls (50);

folding the outer lateral tabs (52, 53) onto the end corner tabs (55) and the inner lateral tabs (51); and ejecting the partially finished inner pack (12) from the pocket (61) of the folding turret (60) in conjunction with the folding of the front wall (36) of the inner pack (12), wherein the end corner tabs (55) are folded by folding devices (68) arranged fixed in an ejection station of the folding turret (60) into the respective plane of the lateral wall (50) of the inner pack (12).

2. The method as claimed in claim 1, further comprising providing the inner pack (12) with a closure label (42) in a region of a label folding station (81), wherein the inner pack (12) facing transversely to a transport direction along an upright conveyor section (75) and having an exposed end wall (37) is transported in the transport direction facing sideways along the upright conveyor section (75), and the closure label (42) is positioned initially against the exposed end wall (37) and is then folded by means of a folding device (82) in the region of the rear wall (39) and the front wall (36).

3. The method as claimed in claim 2, wherein the inner pack (12) has an access opening (35) in the region of the end wall (37) and the adjoining front wall (36) of the inner pack (12), wherein the closure label (42) is positioned on the inner pack (12) in such a way that the access opening (35) is closed.

4. The method as claimed in claim 2, wherein the closure label (42) is positioned on the inner pack (12) in the label folding station (81) by means of the folding device (82), whereas the inner pack (12) is conveyed continuously in the transport direction, wherein the folding device (82) is moved together with the pack (12) in the transport direction also is moved transversely to the transport direction, in order to fold the closure label (42) against the rear wall (39) and the front wall (36).

5. The method as claimed in claim 2, further comprising feeding the inner pack (12) with the closure label (42) positioned thereon to an outer pack folding turret (84) for the production of the outer pack (13), wherein a blank (30) for the outer pack (13) is stamped into a pocket of the outer pack folding turret (84) and is partially folded, and wherein the inner pack (12) with the closure label (42) is introduced into the outer pack (13) as pack contents, and a front wall, lateral walls, and a lid of the outer pack (13) are then formed by folding the blank (30) for the outer pack (13).

* * * * *